United States Patent [19]

Weiss

[11] 4,002,884

[45] Jan. 11, 1977

[54] HEATER ELEMENT FOR AN INDIRECTLY HEATED CATHODE

[75] Inventor: Eberhard Weiss, Stuttgart, Germany

[73] Assignee: International Standard Electric Corporation, New York, N.Y.

[22] Filed: Jan. 24, 1975

[21] Appl. No.: 543,724

[30] Foreign Application Priority Data

Jan. 30, 1974 Germany ..... 2404362

[52] U.S. Cl. ..... 219/552; 219/270; 313/340; 313/344; 338/296

[51] Int. Cl.[2] ..... H05B 3/10

[58] Field of Search ..... 219/270, 275, 552, 553; 317/98; 313/337, 340, 344; 338/296

[56] References Cited

UNITED STATES PATENTS

| | | | |
|---|---|---|---|
| 2,831,140 | 4/1958 | Blickwedel et al. | 313/340 |
| 2,935,638 | 5/1960 | Farrow | 313/340 |
| 3,029,360 | 4/1962 | Etter | 313/340 |
| 3,231,715 | 1/1966 | Hall | 219/275 |
| 3,474,229 | 10/1969 | Rump | 219/552 |
| 3,495,121 | 2/1970 | Katz | 313/346 |
| 3,737,714 | 6/1973 | Theodosopoulas et al. | 313/337 |
| 3,869,692 | 3/1975 | Larson | 313/340 X |

FOREIGN PATENTS OR APPLICATIONS

| | | | |
|---|---|---|---|
| 1,118,456 | 3/1956 | France | 313/340 |
| 1,273,216 | 8/1961 | France | 313/340 |
| 1,184,424 | 12/1964 | Germany | 219/552 |
| 895,337 | 5/1962 | United Kingdom | 313/340 |

*Primary Examiner*—Volodymyr Y. Mayewsky
*Attorney, Agent, or Firm*—John T. O'Halloran; Thomas M. Marshall

[57] ABSTRACT

A small heater wire winding for a fast warm up indirectly heated cathode includes a spacer wire wound over the heater wire. The main winding and spacer wire are coated with insulation to insure spacing between closely wound turns.

2 Claims, 3 Drawing Figures

HEATER ELEMENT FOR AN INDIRECTLY HEATED CATHODE

BACKGROUND OF THE INVENTION

1. Field of the Invention

The present invention relates to a heater element for an indirectly heated cathode and particularly to a small helically wound heating wire positioned closely to the cathode.

2. Description of the Prior Art

In cases where there is only a limited available filament power, it is possible to achieve the shortest cathode-heating time by arranging the source of heat, or the thermal center thereof, as close as possible to the electron-emitting layer of the cathode. A corresponding construction of an indirectly heated cathode has already been proposed in a copending U.S. patent application Ser. No. 418,644, filed Nov. 23, 1973. One decisive factor in bringing the thermal center of the source of heat close to the electron-emitting layer is the length of the heating element. In its usual form, the heating element consists of a coil-shaped wound heating wire, but also meander-shaped configurations have become known. In order to avoid short-circuits in the heating element, the individual windings and turns of the heating wire of the heating element must be insulated from one another.

This insulation, which substantially consists of aluminum oxide, is applied and sintered subsequent to the shaping of the heating element. During the shaping of the heating element, the mutual spacing between the individual windings and turns must be made sufficiently large to reliably avoid any contacts. The extent of this required reliability and safety determines the final spacing in addition to the electrical minimum spacing. In other words, for mechanical and technical production reasons, the longitudinal expansion of the heating element, including the insulation, is greater than electrically necessary.

SUMMARY OF THE INVENTION

It is therefore the object of the present invention to provide an improved small heating element for an instant warm up heater-cathode. In particular a heating element construction is provided in which the spacing or distance between the windings or turns of the heating wire do not have to be made greater than necessary for electrical insulation purposes.

This is achieved by the addition of a spacer wire wound around the filament and having a coating of insulation around both elements. It is of particular advantage that the reduction of the cathode-heating time is accomplished without requiring any modification in the cathode construction, and without having to modify the electrical operating circuit. Details of the invention and further advantages will become apparent from the following description and drawings.

DESCRIPTION OF THE PREFERRED EMBODIMENT

Figure 1:
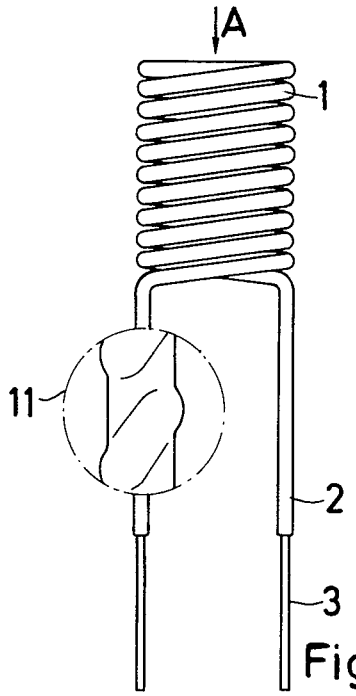
FIG. 1 is a side view of a coil-shaped winding of a one-layer heating element, including an expanded portion.
Figure 2:
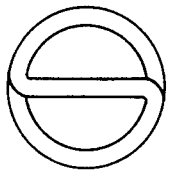
FIG. 2 is a top view of the heating element shown in FIG. 1.

FIG. 1 shows the heating element 1 of an indirectly heated cathode. The heating element, as a rule, consists of several closely adjacent windings which, as shown in the top view of FIG. 2, are wound in one layer. This representation has been chosen only for the sake of clarity, since it is also well known to have heating elements wound in several layers.

The heating element 1 consists substantially of the heating wire 3 which is surrounded by an insulating compound 2, such as of aluminum oxide. This insulating material is generally applied to the heating element 1 in a coating bath subsequent to the shaping, or after the heating wire has been wound, and is thereafter sintered in an oven.

Figure 3:
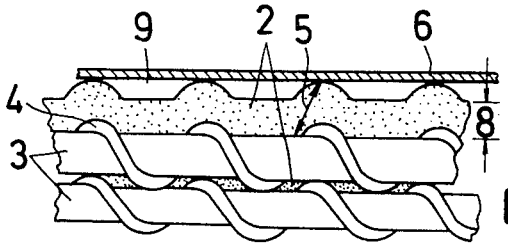
FIG. 3 is a schematic representation of an expanded section of the heating element according to the invention.

As may be seen in FIG. 3, the heating wire 3 shaped to form the heating element, is surrounded by a continuous helically wound distance or spacer wire 4. Independently of the shape of the heating element 1, by means of this distance wire 4, the individual turns of the heating wire will always maintain a mimimum spacing determined by the thickness of the distance wire 4. By correspondingly selecting the pitch of the coil winding spiral of the distance wire, care can now be easily taken that the spacing between two windings of the heating wire will also not exceed the thickness of the distance wire because, as is clearly shown in FIG. 3, the individual windings or turns of the distance wire 4 on adjacent heater wires extend into the spaces between one another.

After having shaped the heating element 1, including the added distance wire, the heater is provided with insulation in a well-known manner. Due to the interspaces between the heating wire turns, which are smaller than in conventional types of heating elements, less insulating material is also required at these points. The insulating material precipitates on the outer surfaces of the heater with a layer thickness 8, but the effective insulation path 5 between the heating wire 3 and the partly indicated cathode tube 6 is actually greater because the insulating material adapts itself to the contour as formed by the distance wire 4. The space indicated by the reference numeral 9 will remain free from insulating material. This is also illustrated by the expanded detail 11 in FIG. 1. Moreover, this involves a substantial saving of insulating material.

When an electrically conducting metal wire is used as the distance wire 4, because of the winding process, care should be taken that this distance wire can be removed subsequently to the solidification or sintering of the insulation. This may be carried out, for example, by way of chemical etching, in a known manner as used in connection with the removal of support wires. It is also possible to use a material for the distance wire which evaporates at the sintering temperature. Another possibility is to use the distance wire as a permanent isolator which remains during the sintering process and stays in place in the finished heating element.

On particular advantage is in the use of such a heating element to provide fast warm up cathodes for television picture tubes. This is the main time factor in turning on television receivers which primarily employ semiconductor circuits.

What is claimed is:

1. A heating element for an indirectly heated cathode comprising:

a heating wire having a plurality of closely wound turns and a spacer wire wound around said heating wire having a thickness providing a spacing between adjacent turns of said heating wire which is equal to the thickness of the spacing wire;

a layer of thermally conductive and electrically insulating material directly coated on said heater and spacer wires and sealing thereof, said spacer wire being of a material which is capable of being removed subsequent to the application of said insulating material, while said insulating material retains the added thickness of said spacer wire, the pitch of the winding of said spacer wire being a multiple of the thickness of the spacer wire, and said heating and spacer wires being disposed so that the spacer wires of two adjacent turns of said heating wire do not contact one another.

2. A heating element for an indirectly heated cathode comprising:

a heater wire having a plurality of closely wound turns and a spacer wire wound around said heater wire having a thickness providing a spacing between adjacent turns of said heating wire which equal to the thickness of the spacing wire;

a layer of thermally conductive and electrically insulating material directly coated on said heater and spacer wires and sealing thereof, said spacer wire being of a material which is not capable of being removed subsequent to the application of said insulating material while said insulating material remains the added thickness of said spacer wire, the pitch of the winding of said spacer wire being a multiple of the thickness of said spacer wire, and said heating and spacer wires being disposed so that the spacer wires of two adjacent turns of said heating wire do not contact one another.

* * * * *